US005848920A

United States Patent [19]

Klein et al.

[11] Patent Number: 5,848,920

[45] **Date of Patent: *Dec. 15, 1998**

[54] FABRICATION OF ELECTRICAL TERMINALS FOR EDGE CARD CONNECTORS

[75] Inventors: Daniel Thomas Klein, Streamwood; Gregory R. Pratt, Naperville; Kent E. Regnier, Lombard, all of Ill.

[73] Assignee: Molex Incorporated, Lisle, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 683,553

[22] Filed: Jul. 16, 1996

[51] Int. Cl.[6] ..... H01R 9/24

[52] U.S. Cl. ..... 439/885; 439/60

[58] Field of Search ..... 439/885, 60, 637

[56] References Cited

U.S. PATENT DOCUMENTS

| | | | |
|---|---|---|---|
| 3,530,422 | 9/1970 | Goodman | 439/733.1 |
| 3,618,207 | 11/1971 | Sand et al. | 29/882 |
| 3,868,166 | 2/1975 | Ammon | 439/634 |
| 4,197,636 | 4/1980 | Osanai | 29/882 |
| 4,292,736 | 10/1981 | Hughes et al. | 29/884 |
| 4,795,374 | 1/1989 | Rishworth et al. | 439/634 |
| 4,996,766 | 3/1991 | Piorunneck et al. | 439/637 |
| 5,013,255 | 5/1991 | Juret et al. | 439/260 |
| 5,145,383 | 9/1992 | Bowen et al. | 439/885 |
| 5,188,546 | 2/1993 | Ballard et al. | 439/885 |
| 5,201,883 | 4/1993 | Atoh et al. | 29/883 |
| 5,263,870 | 11/1993 | Billman et al. | 439/637 |
| 5,387,133 | 2/1995 | Tondreault et al. | 439/637 |
| 5,411,408 | 5/1995 | DiViesti et al. | 439/637 |
| 5,584,709 | 12/1996 | Kiat | 439/79 |

FOREIGN PATENT DOCUMENTS

| | | | |
|---|---|---|---|
| 1-235177 | 9/1989 | Japan | H01R 43/20 |

*Primary Examiner*—Neil Abrams
*Assistant Examiner*—T C Patel
*Attorney, Agent, or Firm*—Charles S. Cohen

[57] ABSTRACT

An elongate strip of electrical terminals adapted to be inserted into a row of terminal-receiving passages in connector housing is disclosed. The strip includes a series of terminals joined by a mid-carrier strip and includes alternating first and second terminals. The terminals have base portions with retention sections adapted to be inserted into the terminal-receiving passages. Spring arms having contact portions extend from first ends of the base portions. Tail portions extend from second, opposite ends of the base portions. The mid-carrier strip joins the alternating first and second terminals at the base portions of the first terminals and at the spring arm of the second terminals. A second carrier strip joins the tips of the tail portions of only the first terminals so that the adjacent ends of the second terminals can be formed independent of the first terminals.

14 Claims, 10 Drawing Sheets

FABRICATION OF ELECTRICAL TERMINALS FOR EDGE CARD CONNECTORS

FIELD OF THE INVENTION

This invention generally relates to the art of electrical connectors and, particularly, to various improvements in the fabrication of elongate strips of electrical terminals for use in edge card electrical connectors.

BACKGROUND OF THE INVENTION

A popular type of electrical connector which is used widely in the electronic industry is called an "edge card" connector. An edge card or edge connector receives a printed circuit board having a mating edge and a plurality of contact pads adjacent the edge. Such edge connectors have an elongated housing defining an elongated receptacle or slot for receiving the mating edge of the printed circuit board. A plurality of terminals are spaced along one or both sides of the slot for engaging the contact pads adjacent the mating edge of the board. In many applications, such edge connectors are mounted on a second printed circuit board. The mating edge board or card commonly is called the "daughter" board, and the board to which the connector is mounted commonly is called the "mother" board.

One of the problems with edge connectors of the character described above centers around the ever-increasing demands for high density electronic circuity. The terminals of such a connector are mounted in a housing fabricated of dielectric material such as plastic or the like. Not only is the housing small in order to take up relatively little real estate on the mother board, but the spacing or "pitch" between the terminals is becoming smaller and smaller.

In order to increase the density of terminals in edge connectors, it has become known to design the connector as a bi-level connector. In such bi-level connectors, terminals are provided with contact portions that contact the daughter printed circuit board at two locations or at two levels relative to the mating edge of the board. Often, the different terminals are in an alternating arrangement along the length of the card-receiving slot in the connector housing and may be in two rows along opposite sides of the slot. Still, continuing problems arise in the fabrication of such high density terminals.

For instance, it is known to fabricate separate elongated strips of electrical terminals of different shapes. In other words, it is known to fabricate stamped and formed electrical terminals from elongate strips of conductive sheet metal material. Therefore, if two different shapes of terminals are used in an elongate edge connector, two strips of electrical terminals of two different shapes may be employed. However, this methodology involves high fabrication costs, including the use of excessive sheet metal material as well as additional insertion steps for inserting the terminals into a connector housing.

Another known approach in fabricating elongate strips of electrical terminals for use in edge connectors has been to fabricate a single elongate strip having two types of terminals alternating therealong. However, the use of a single, hybrid elongate strip having two types of terminals makes it difficult to decrease the spacing between the terminals along the strip.

The problems outlined above are further complicated when certain features, parameters or characteristics are desired to be incorporated in the array of terminals along the edge card slot. For instance, it may be desirable to provide all of the terminals with equal electrical path lengths regardless of the particular shape of the terminals. It usually is desirable for the tips of the tail portions of all of the terminals to be generally coplanar. It also may be desirable to have the tail portions of the terminals staggered in at least two rows along the length of the connector in order to increase the density of the "footprint" of circuit traces, pads or holes on or in the mother printed circuit board.

The present invention is directed to various novel concepts for fabricating electrical terminals for use in edge connectors and which solve one or more of the problems discussed above.

SUMMARY OF THE INVENTION

An object, therefore, of the invention is to provide improvements in the fabrication of electrical terminals adapted to be inserted in a row or rows of terminal-receiving passages in an edge card connector housing.

In the exemplary embodiment of the invention, the elongate strip of electrical terminals includes a series of terminals joined by a carrier strip and including alternating first and second shapes of terminals. The first shape of terminal includes a generally planar base portion having a retention section for mounting the terminal in a respective one of the terminal-receiving passages. A tail portion projects from one end of the base portion. A resilient spring arm having a contact portion extends from a second opposite end of the base portion. The second shape of terminal also includes a generally planar base portion having a retention section for mounting the terminal in a respective one of the terminal-receiving passages, a tail projecting from one end of the base portion, and a resilient spring arm having a contact portion extending from an opposite end of the base portion. The spring arm of the second shape of terminal includes a section offset laterally of the base portion thereof. The carrier strip joins the alternating first and second shapes of terminals at the base portions of the terminals of the first shape and at the offset sections of the spring arms of the terminals of the second shape.

As disclosed herein, the tips of the tail portions of the first and second shapes of terminals are generally coplanar. The contact portions of the terminals of the first shape extend a greater vertical distance from the plane of the tips than the contact portions of the terminals of the second shape. In addition, the electrical paths of the first and second shapes of terminals from the plane of the tips of the tail portions to the contact portions of the terminals are of substantially equal lengths.

The invention also contemplates the use of a second carrier strip joining the tips of the tail portions of at least some of the terminals. As disclosed herein, the second carrier strip joins the tips of the tail portions of only the terminals of the first shape. Therefore, the tail portions of the terminals of the second shape can be formed independent of the terminals of the first shape.

Lastly, the invention contemplates a corresponding method of fabricating a strip of electrical terminals. The method includes the steps of providing an elongate strip of electrically conductive sheet metal material. The strip is stamped to produce a series of terminals comprising alternating first and second shapes of terminals with base portions having retention sections adapted to be inserted into a row of terminal-receiving passages in a connector housing. A spring arm having a contact portion extends from a first end of the base portion, and a tail portion extends from a second opposite end of the base portion. A carrier strip joins all of the terminals intermediate opposite ends thereof. Tips of the tail portions of the second shape of terminals are located further from said carrier strip than tips of the first shape of terminals. The method contemplates that this stamped strip then be formed by bending the second shape of terminals to offset the retention section and a portion of the spring arm thereof laterally of the retention sections of the first shape of terminals and to position the tail portions thereof so that the tips of the tail portions of both shapes of terminals are generally coplanar.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
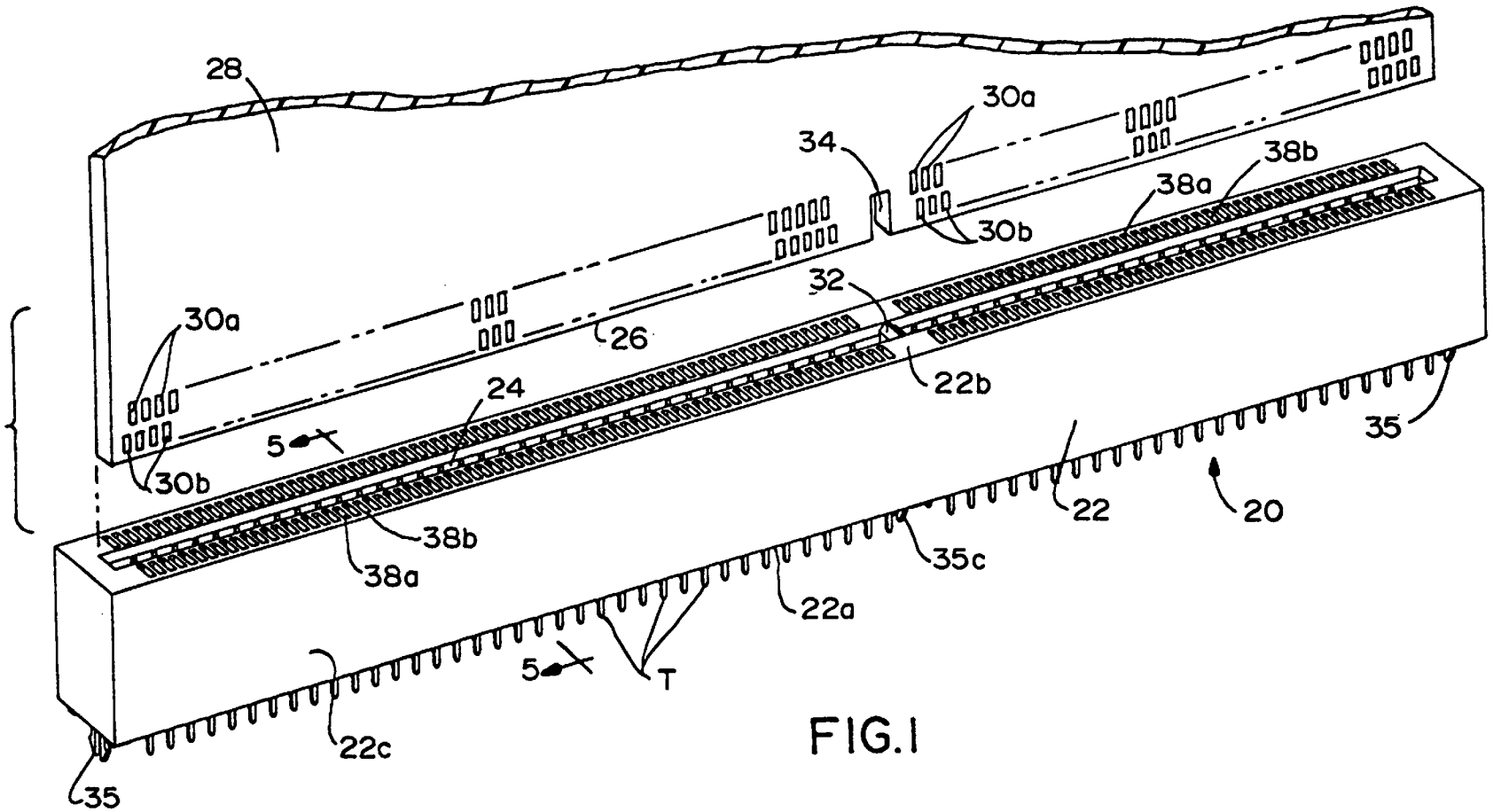
FIG. 1 is a perspective view of an electrical connector for incorporating electrical terminals fabricated according to the invention, in conjunction with a fragmented depiction of an edge of a printed circuit board insertable into the connector.

Referring to the drawings in greater detail, and first to FIGS. 1–4, an elongated electrical connector, generally designated 20, of the edge card type is shown. The connector is typical of this type of electrical connector in that it includes a unitarily molded, elongate housing 22 defining a board-mounting or terminating face 22*a* and a board-receiving face 22*b*. The board-receiving face 22*b* includes an elongate receptacle or card slot 24 for receiving a mating edge 26 of a printed circuit board 28. A plurality of terminals (described hereinafter) are spaced along both sides of slot 24 for engaging contact pads 30*a* and 30*b* adjacent mating edge 26 on both sides of printed circuit board 28. It can be seen that contact pads 30*a* and 30*b* are in two rows, with the row of contact pads 30*b* being closer to edge 26 than the row of contact pads 30*a*. Each of the rows 30*a* and 30*b* is generally parallel to mating edge 26. Lastly, a polarizing rib 32 spans slot 24 for insertion into a polarizing notch 34 in edge 26 of the printed circuit board to ensure the board is properly oriented endwise within the slot relative to the elongate connector.

In many applications, edge card connectors, such as connector 20, are mounted on a second printed circuit board. The mating circuit board 28 commonly is called the "daughter" board, and the board 29 (FIG. 5) to which the connector is mounted commonly is called the "mother" board. Connector 20 is of this type and includes three boardlocks 35 (the middle boardlock is labeled 35 *c*) for insertion into appropriate mounting holes in the mother board. A plurality of standoffs 36 project downwardly from board-mounting face 22*a* of housing 22 a predetermined distance to space the housing from the mother board upon placement thereon.

Figure 3:
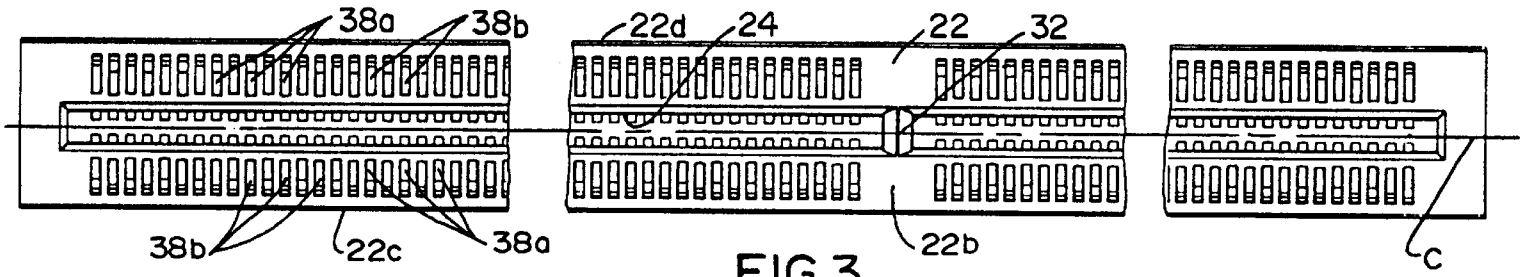
FIG. 3 is a fragmented top plan view of the connector housing of FIG. 2.
Figure 2:
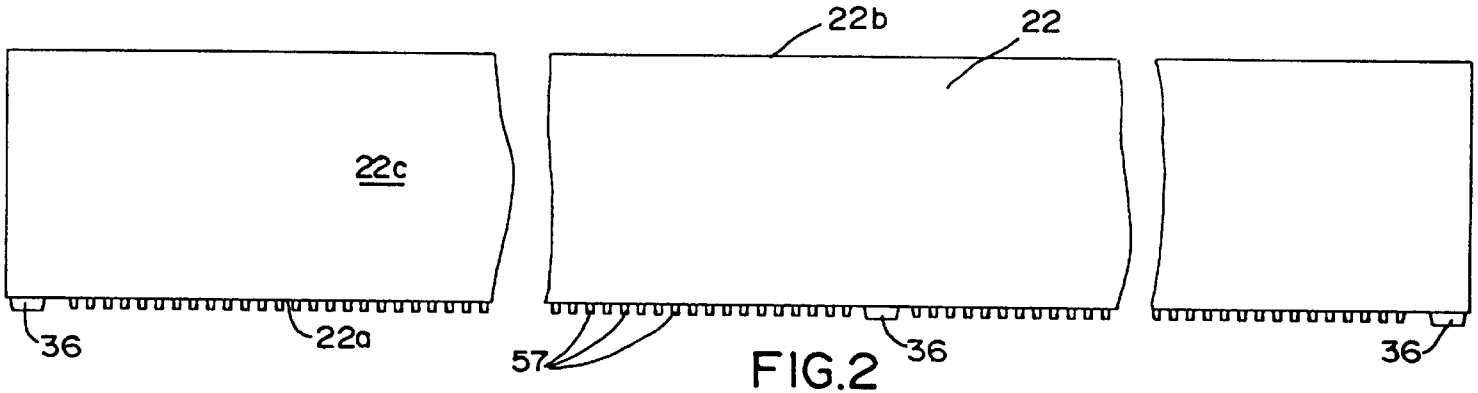
FIG. 2 is a fragmented front elevational view of the connector housing.

FIGS. 1 and 3 best show that elongate housing 22 of connector 20 has two rows of terminal-receiving cavities or passages extending lengthwise of the housing generally parallel to the longitudinal axis of the housing, one on each of opposite sides of card slot 24. Each row includes an alternating series of differently shaped first and second cavities 38*a* and 38*b*. In addition, the shapes within one row are offset relative to the other row by the distance between adjacent cavities. As a result, each first cavity 38*a* has a differently shaped second cavity 38*b* on both sides of it within its row and as well as an additional second cavity 38*b* laterally across card slot 24 in the other row of cavities.

Figure 4:
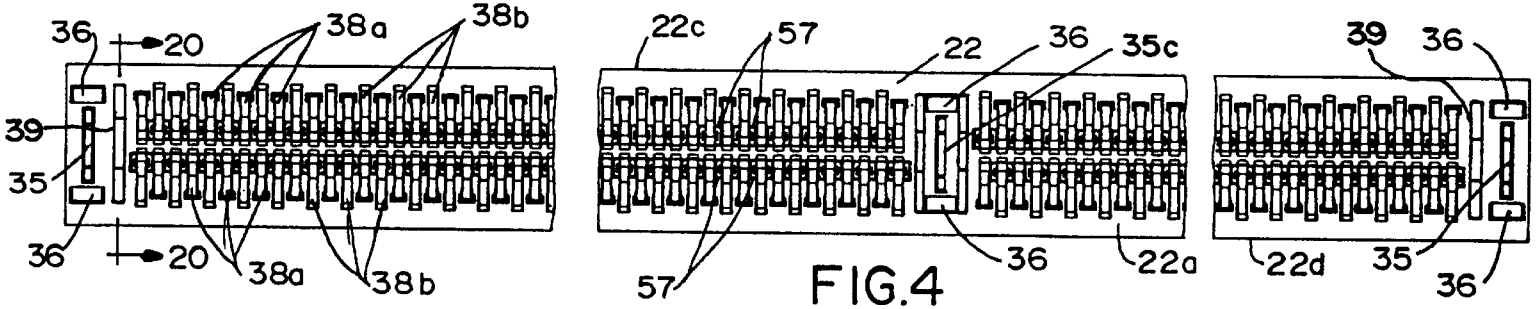
FIG. 4 is a fragmented bottom plan view of the connector housing of FIG. 2.
Figure 5:
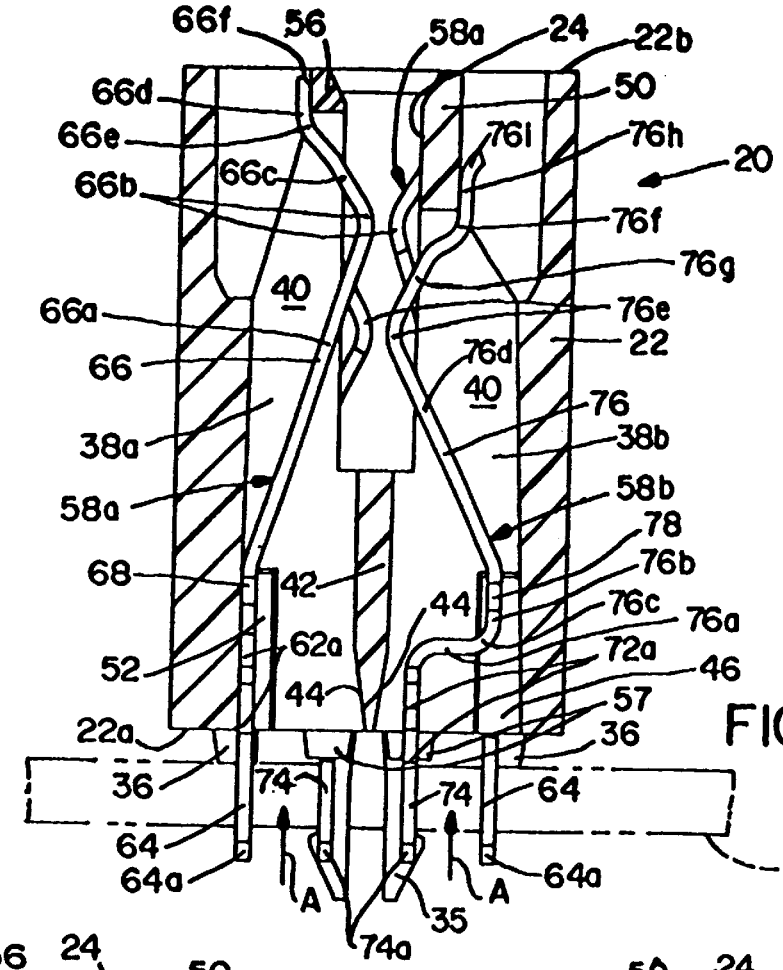
FIG. 5 is an enlarged vertical section taken generally along line 5—5 of FIG. 1.
Figure 6:
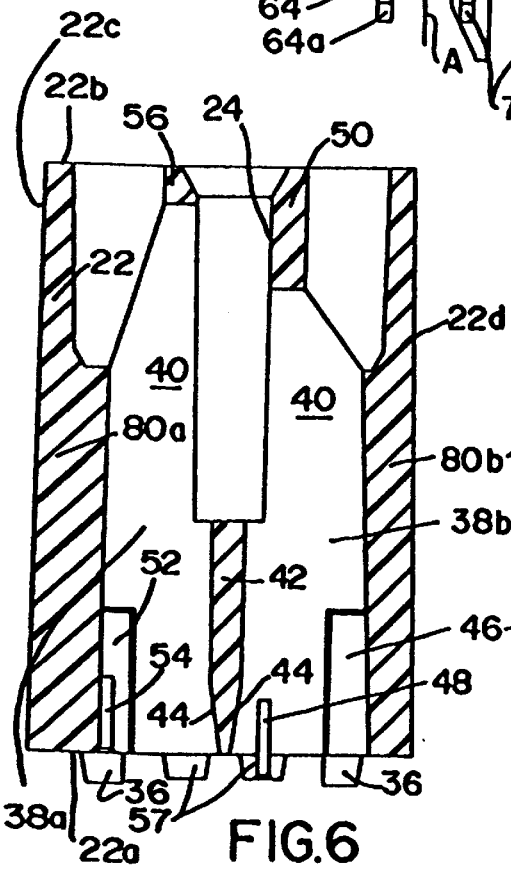
FIG. 6 is a view similar to that of FIG. 5, but with the terminals removed.
Figure 7:
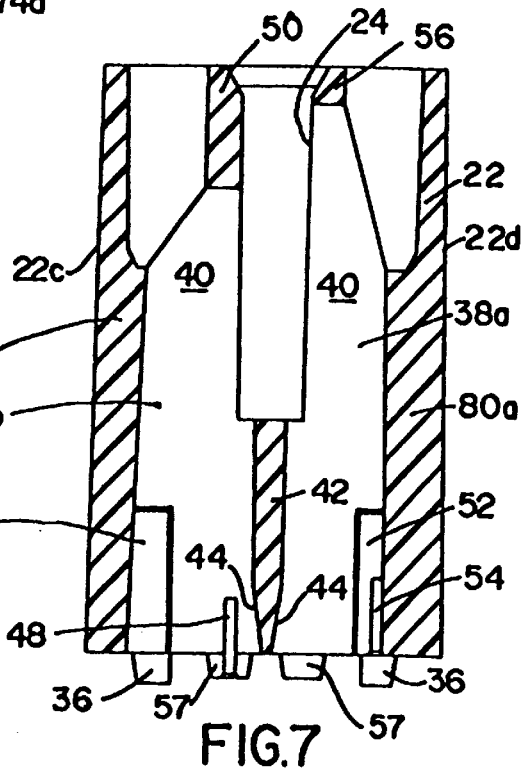
FIG. 7 is a vertical section through the housing similar to FIG. 6, but of an adjacent pair of terminal-receiving cavities.

More particularly, referring to FIGS. 5–7 in conjunction with FIGS. 1–4, housing 22 includes a series of the pairs of first and second cavities 38*a* and 38*b* with one pair of the cavities shown in each of FIGS. 5, 6 and 7. FIGS. 5 and 6 show first cavity 38*a* on the left-hand side of slot 24 with second cavity 38*b* on the right-hand side of the slot. Conversely, FIG. 7 shows one of the first cavities 38*a* on the right-hand side of slot 24, whereas second cavity 38*b* is shown on the left-hand side of the slot. These depictions in the drawings illustrate that the first and second cavities 38*a* and 38*b* alternate lengthwise of the connector housing on opposite sides of the slot. All of the adjacent cavities in each row thereof are separated lengthwise along the housing by transverse walls 40.

Still referring to FIGS. 5–7, a reinforcing rib 42 is disposed in the lower half of the housing separating the two cavities 38*a* and 38*b* in each pair thereof. The reinforcing ribs 42 not only separate the cavities, but also span the cavities and are integrally molded between transverse walls 40 to provide support for the walls and allow the walls to be molded as thin as possible, thereby enhancing the high density nature of the connector. All of the reinforcing ribs between adjacent cavities 38*a* and 38*b* are located along a longitudinal centerline "C" of housing 22 (FIG. 3) immediately below slot 24 as can be seen by comparing FIGS. 6 and 7. Lastly, each reinforcing rib 42 is tapered, as at 44, at its bottom end to provide a camming surface for engaging the terminals and assisting during insertion of the terminals into first and second cavities 38*a* and 38*b*, as described hereinafter. Therefore, it can be understood that reinforcing ribs 42 perform a multitude of functions.

Each second cavity 38*b* includes an enlarged recess 46 and an inner press-fit terminal retention slot 48 in each of its transverse walls 40, as well as an upper preloading wall 50, all for different purposes in cooperating with a respective terminal inserted into the cavity. Similarly, each cavity 38*a* includes an enlarged recess 52 and an outer press-fit terminal retention slot 54 in its transverse walls 40, as well as a preloading wall 56, again for cooperating with a respective terminal inserted into the cavity. It can be seen that preloading wall 56 of cavity 38*a* is shorter than preloading wall 50 of cavity 38*b*.

A plurality of retention bosses 57 are molded integrally with housing 22 in alignment with terminal-receiving cavities 38*b* whereby the cavities extend through the retention bosses. Actually, the retention bosses are "split" portions of housing 22 projecting downwardly from transverse walls 40 on opposite sides of terminal-receiving cavities 38*b* adjacent the lower portions of the retention sections of the terminals received in the cavities as described below. As best seen in FIG. 5, the standoffs 36 extend downward from board-mounting face 22*a* of housing 22 slightly further than retention bosses 57 extend downward. As a result, the retention bosses will not contact printed circuit board 29 when the connector 20 is mounted thereon.

Figure 20:
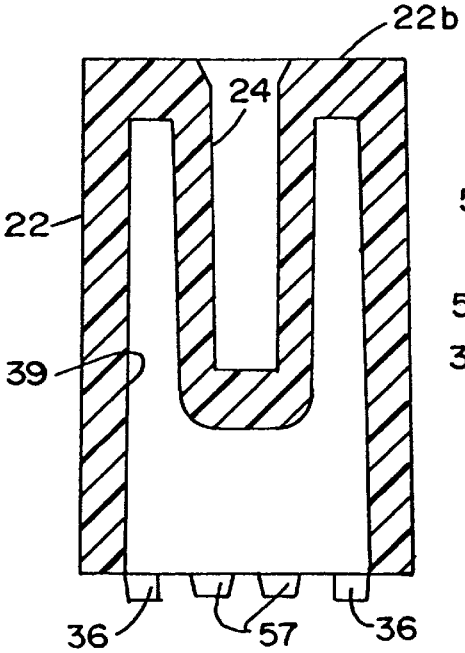
FIG. 20 is an enlarged vertical section taken generally along line 20—20 of FIG. 4.

As shown in FIGS. 4 and 20, a recess 39 is located adjacent the opposite ends of the rows of terminal receiving cavities 38*a* and 38*b*. In addition, a pair of recesses 39 are located on opposite sides of center boardlock 35*c* which is aligned with and positioned below polarizing rib 32. These recesses 39 extend laterally from the longitudinal axis of the housing at least as far as the terminal receiving cavities 38*a* and 38*b*, and preferably slightly further. In the vertical direction, they extend in a manner similar to cavities 38*a* and 38*b* although they do not extend through board-receiving face 22*b* of the housing. These recesses 39 provide additional flexibility to the plastic housing at the inner and outer press-fit slots 48 and 54 adjacent the ends of the housing and the center boardlock 35*c* in order to reduce the likelihood of cracking of the housing. In addition, they also reduce shrinkage of the plastic.

Generally, electrical connector 20 includes a series of simple cantilevered beam terminals along each side of slot 24. The terminals of such series include first and second shapes, generally designated 58*a* and 58*b*, respectively, that are inserted into cavities 38*a* and 38*b*, respectively, in the direction of arrows "A" (FIG. 5).

Figures 8, 9:
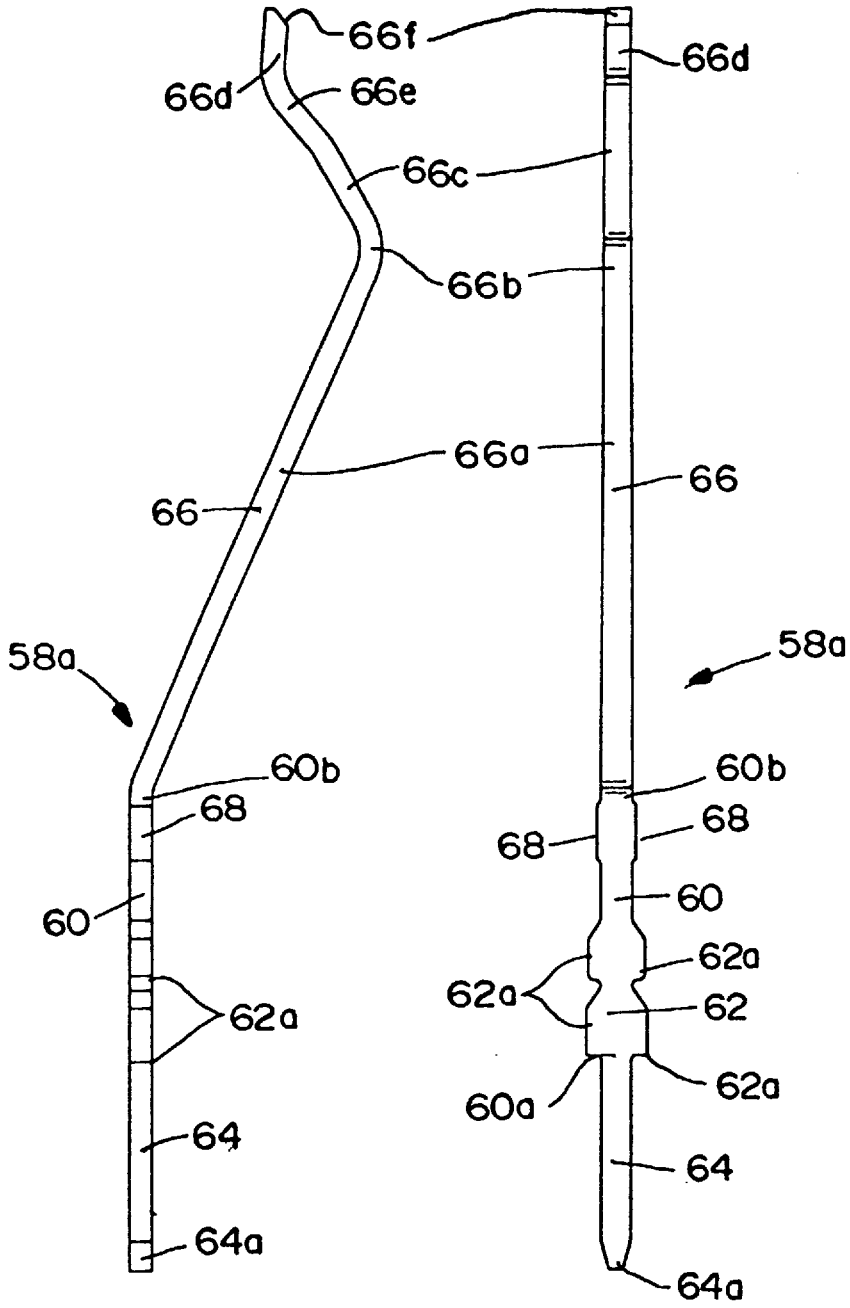
FIGS. 8 and 9 are side elevational and plan views, respectively, of one of the two different shapes of terminals.

More particularly, referring to FIGS. 8 and 9 in conjunction with FIG. 5, first terminal 58*a* insertable into a respective one of the cavities 38*a* includes a generally planar base portion 60 having a retention section 62 with outwardly projecting barbs 62*a* (FIG. 9) on opposite side edges thereof. A tail portion 64 projects from one end 60*a* of base portion 60 and includes a tapered tip 64*a*. A resilient spring arm or beam 66 extends from a second, opposite end 60*b* of the base portion at approximately a 24° angle thereto. The spring arm includes a first generally straight section 66*a* that extends up to an inwardly bowed contact section 66*b*, which projects into slot 24 as best seen in FIG. 5. Although difficult to see in the drawings, straight section 66*a* is tapered so it is widest adjacent base 60 and narrowest adjacent contact section 66*b*. This reduces stress concentrations in the arm 66. A relatively steep lead-in section 66*c* is positioned above contact section 66*b* with a generally vertical upper arm section 66*d* adjacent the end of arm 66. A generally arcuate transition section 66*e* extends between lead-in section 66*c* and upper arm section 66*d* in order to permit the lead-in section to have its desired angle relative to vertical to provide a low insertion force yet position upper arm section 66*d* generally vertically to engage preloading wall 56. As best seen in FIG. 5, the lead-in section 66*c* extends from slot 24 slightly into cavity 38*a* to ensure that the edge 26 of card 28 initially engages lead-in section 66*c*. Finally, the tip 66*f* of arm 66 is coined or chamfered to prevent stubbing while inserting the terminal 58*a* into cavity 38*a* during the assembly process.

Finally, FIG. 9 shows a pair of protrusions 68 at opposite side edges adjacent second end 60*b* of base portion 60 which are the result of severing the terminal from a mid-carrier strip 82 (described hereinafter). In essence, these protrusions comprise cutoffs of the carrier strip. When each terminal 58*a* is inserted into its respective cavity 38*a*, cutoffs 68 are aligned with enlarged recesses 52. The recesses are sufficiently large and deep enough to prevent any interference with the cutoffs and to allow free movement during insertion of the terminal into the housing in the area of the cutoffs.

Figure 10:
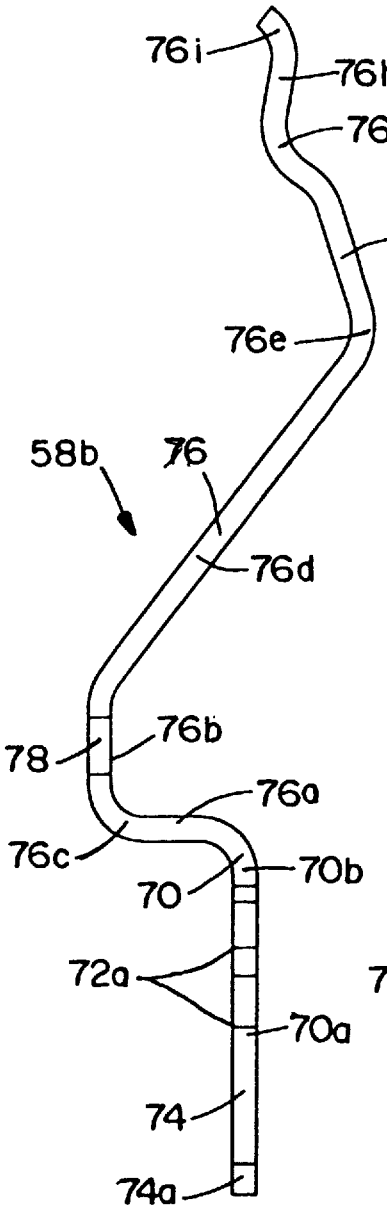
FIGS. 10 and 11 are side elevational and plan views, respectively, of the second shape of terminals.
Figure 11:
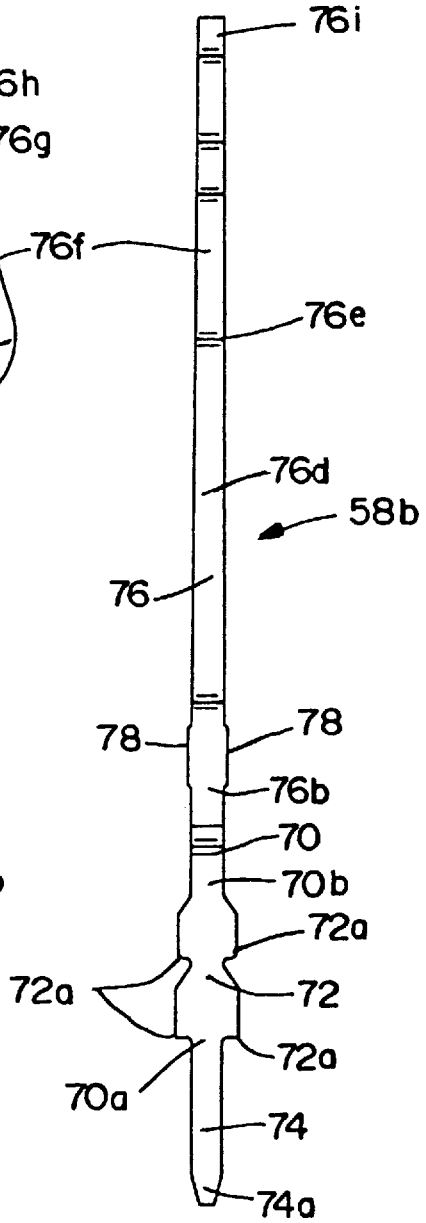

Referring to FIGS. 10 and 11 in conjunction with FIG. 5, each of the second terminals 58*b* includes a generally planar base portion 70 having a retention section 72 which includes barbs 72*a* at opposite side edges thereof. A tail portion 74 projects from one end 70*a* of base portion 70 and includes a tapered tip 74*a*. A resilient spring arm or beam 76 extends from a second, opposite end 70*b* of the base portion 70. The spring arm 76 includes a generally horizontal first section 76*a* extending from the base at approximately a 90° angle thereto and leads to a generally vertical second section 76*b* with an arcuate lower transition section 76*c* therebetween. A generally straight third section 76*d* extends from vertical section 76*b* at approximately a 38° angle thereto and ends in an inwardly bowed contact section 76*e*. Although difficult to see, such third section is tapered to reduce stress concentrations within the beam. A relatively steep lead-in section 76*f* extends away from contact section 76*e* where it intersects with an arcuate upper transition section 76*g*. As best seen in FIG. 5, lead-in section 76*f* extends from slot 24 slightly into cavity 38*b* to ensure that the edge 26 of card 28 initially engages lead in-section 76*f*. A generally vertical upper arm 76*h* for engaging preload wall 50 extends upwardly from upper transition section 76*g* and ends in curved or arcuate tip 76*i*. The curved tip minimizes the likelihood of stubbing of the terminal while inserting the terminal 58*b* into cavity 38*b* during the assembly process.

Somewhat similar to first terminal 58*a*, each second terminal 58*b* also includes mid-carrier cutoffs 78 which become located between enlarged recesses 46 of the respective cavity. The recesses 46 are sufficiently large and deep to allow for free movement of horizontal section 76*a* and vertical section 76*b* relative to the housing both during insertion of the terminal into the housing as well as operatively when fully inserted therein and a daughter printed circuit board 28 is inserted into slot 24.

In comparing FIGS. 6 and 7, it can be seen that housing 22 has side walls 22*c* and 22*d* bounding the outsides of cavities 38*a* and 38*b*. Since the cavities 38*a* and 38*b* alternate along the length of housing 22, the thickness of side walls 22*c* and 22*d* also alternate along the length of the housing. The thicker portion of the side walls 22*c'* and 22*d* is designated 80*a* and associated with cavity 38*a* while the thinner portion is designated 80*b* and associated with cavity 38*b*. The thickened portion 80*a* of the side wall provides additional support for transverse walls 40 of cavity 38*a* as the retention section of terminal 58*a* is press-fit into slots 54 in the transverse walls. In fact, it can be seen in FIGS. 6 and 7 that press-fit slots 54 are located immediately adjacent the thickened portions 80*a* of the side walls. As such, it can be seen in FIG. 5 that base 60 of first terminal 58*a* is next to and supported by the thicker portion 80*a* of the side wall on one side. This assists in preventing movement of any portion of the terminal except spring arm 66.

Figure 19:
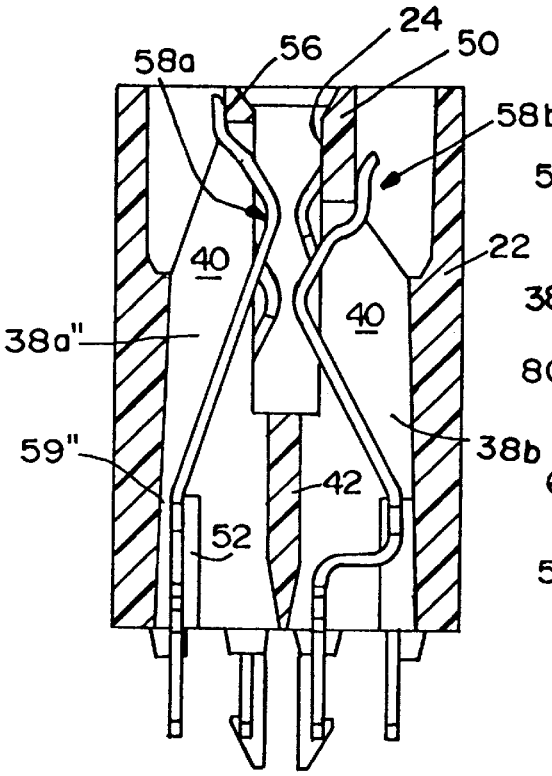
FIG. 19 is an enlarged vertical section similar to FIG. 5 showing still another alternate embodiment of the connector housing.
Figure 17:
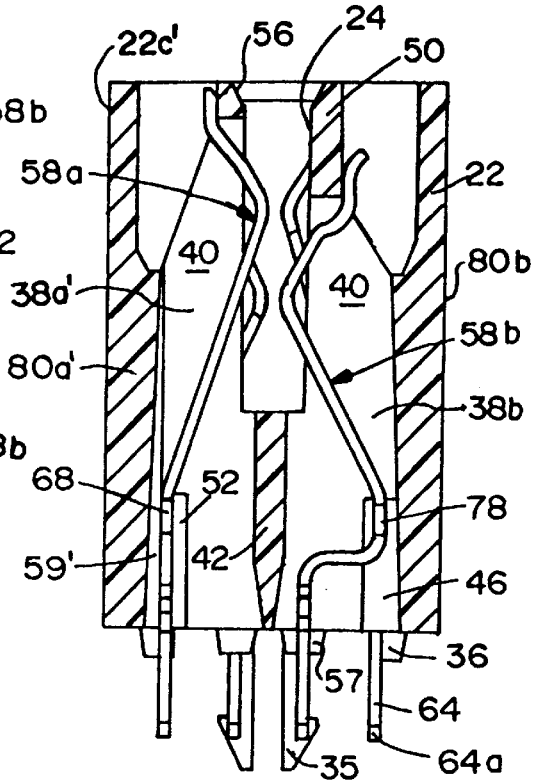
FIG. 17 is an enlarged vertical section similar to FIG. 5 showing an alternate embodiment of the connector housing.
Figure 18:
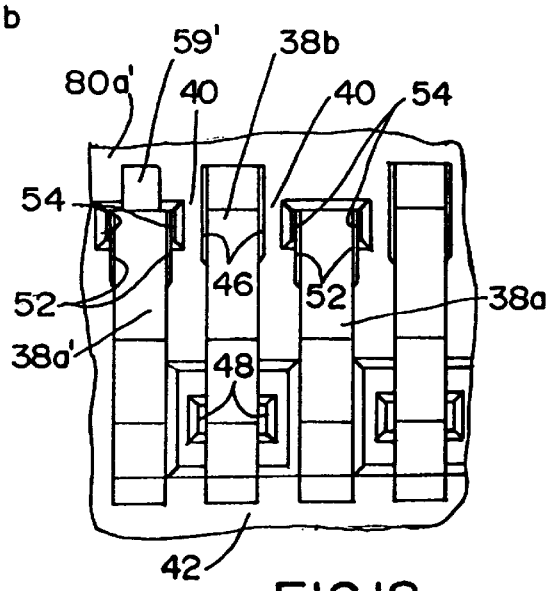
FIG. 18 is an enlarged fragmented bottom plan view of a portion of the connector housing showing a plurality of terminal receiving cavities and one cavity modified as shown in FIG. 17.

FIGS. 17 and 18 show an alternate embodiment wherein a modified first cavity 38*a'* extends slightly further into sidewall 22*c* as compared to an unmodified first cavity 38*a*. This provides additional flexibility at the end of transverse wall 40 adjacent side wall 22*c'*. The extension 59' of cavity 38*a'* can best be seen in FIG. 18 wherein a second cavity 38*b* is shown between a modified first cavity 38*a'* and an unmodified first cavity 38*a*. The width of the extension 59' between transverse walls 40 is less than the width of the main portion of cavity 38*a'*. In the alternative, as shown in FIG. 19, the extension 59" could be widened so that the width between the transverse walls 40 is uniform throughout cavity 38*a"*, including extension 59". In either case, since the width of the extension 59" is still less than the distance across cutoffs 68, terminal 58*a* is still supported along base 60 to prevent outward deflection thereof.

It can be seen in FIG. 5 that the tips 64*a* of tail portions 64 of terminals 58*a* and the tips 74*a* of tail portions 74 of terminals 58*b* all substantially lie in a common plane generally parallel to the mother board 29. In use, all of the tails will be inserted into holes in the mother board and, generally, the circuit traces on the mother board are generally coplanar. It is desirable to have the electrical paths through both shapes of terminals 58*a* and 58*b* be of equal lengths, while still having the terminals engage the contact pads 30*a* and 30*b* (FIG. 1) along edge 26 of printed circuit board 28 at two different levels, as described above. It can be seen that contact sections 66*b* of terminals 58*a* engage contact pads 30*a* at a different level than contact sections 76*e* of terminals 58*b*. This permits an increase in density of the terminals without substantially increasing the insertion forces. Although the contact sections 76*e* of terminals 58*b* are closer vertically to mother board 29 than the contact sections 66*b* of terminals 58*b*, the electrical paths through the terminals between the contact sections and the tips of the tails are substantially equal. In addition, the specific shapes of the spring arms of terminals 58*a* and 58*b* provide for substantially similar normal forces on contact pads 30*a* and 30*b* since the spring arms have substantially similar spring rates and are deflected equal amounts.

During assembly, the terminals 58*a* and 58*b* are inserted into their respective cavities 38*a* and 38*b* from the bottom or terminating face 22*a* of the housing. As the terminals enter their respective cavities, their respective contact section 66*b* and 76*e* initially contact the tapered lower portion 44 of center reinforcing rib 42 that separates the two cavities 38*a* and 38*b*. The contact sections 66*b* and 76*e* slide along the center rib 42 until they reach slot 24. A tool (not shown) generally shaped like edge card 28 is positioned within slot 24 in order to further deflect the contact arms 66 and 76 of the two terminals 58*a* and 58*b*. By engaging this tool, the generally vertical upper arms 66*d* and 76*h* of the two terminals are properly positioned so that they will slide behind their respective preloading walls 56 and 50.

As the terminals are inserted into their respective cavities, their respective cutoffs 68 and 78 enter recesses 52 and 46. Since the distance between the recesses 52 in the transverse walls 40 on opposite sides of cavity 38*a* is greater than the width across cutoffs 68, the cutoffs 68 do not bind or engage the recesses during insertion. Likewise, the distance between transverse walls 40 at recesses 46 is larger than the distance across cutoffs 78 so that the cutoffs 78 also do not bind or engage the walls of the recesses during insertion of the second terminals 58*b*. As the first terminal 58*a* is inserted into its final position, retention section 62, including barbs 62*a*, are press-fit into outer retention slot 54 (FIG. 6). During such insertion, the barbs 62*a* skive or dig into the side walls of the slot 54 to retain the terminal within the housing. Likewise, during insertion of second terminal 58*b*, the retention section 72, including barbs 72*a*, are press-fit into inner retention slot 48. During such insertion, the barbs 72*a* also skive or dig into the side walls of slot 48 to retain the terminal 58*b* within the housing.

Figure 12:
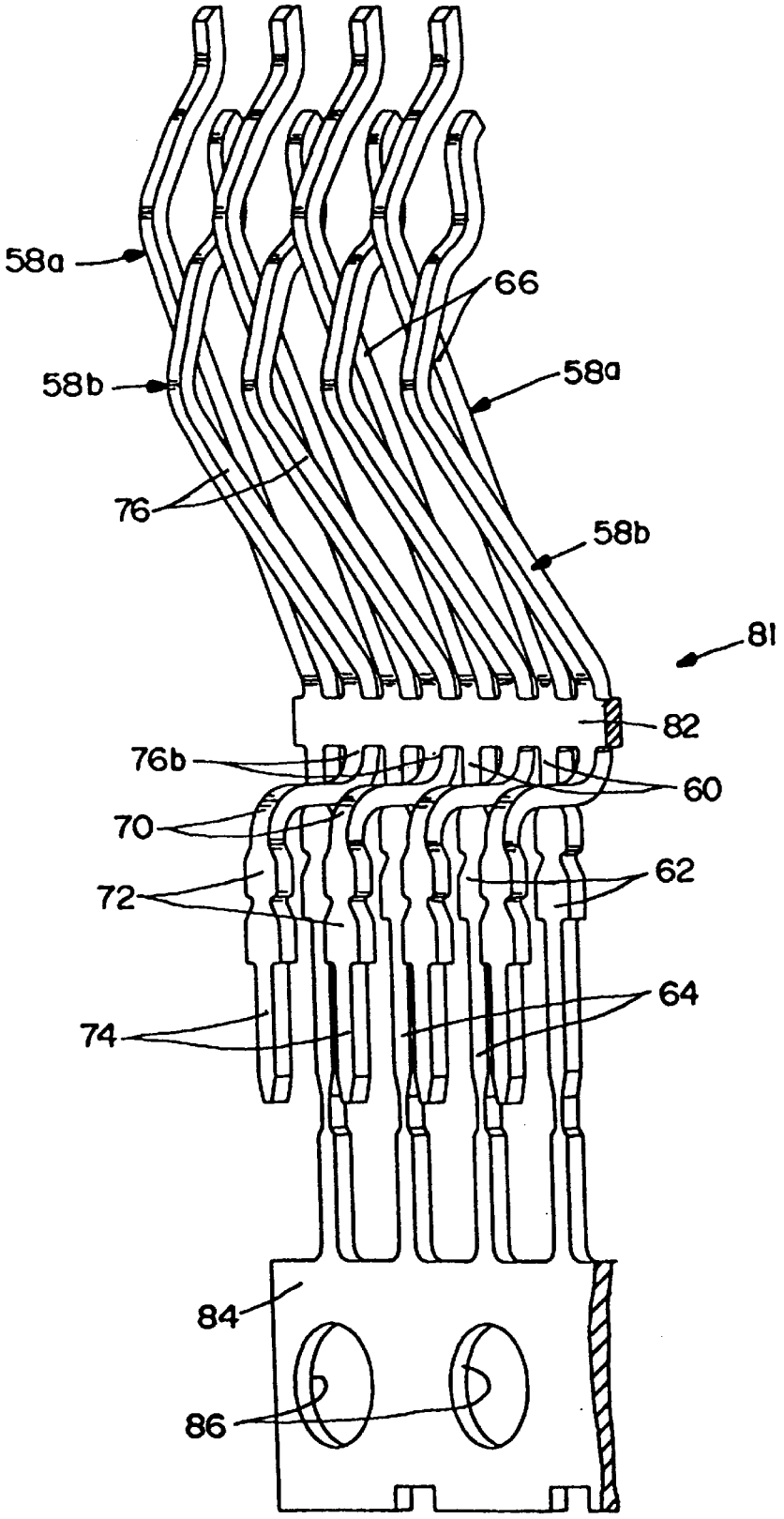
FIG. 12 is a fragmented perspective view of an elongate strip of electrical terminals still interconnected by the main carrier strip and the mid-carrier strip.

FIG. 12 shows the different shapes of terminals 58*a* and 58*b* after fabrication and as integral components of a stamped and formed elongate strip of electrical terminals, generally designated 81. First and second terminals 58*a* and 58*b*, respectively, alternate lengthwise of elongate strip 81. The series of alternating terminals are joined by a mid-carrier strip 82 and a second carrier strip 84.

Still referring to FIG. 12, mid-carrier strip 82 joins first and second terminals 58*a* and 58*b*, respectively, at the base portions 60 of the first terminals 58*a* and the vertical sections 76*b* of the spring arm 76 of the second terminals 58*b*. This mid-carrier strip 82 facilitates forming of the lower portion of second terminals 58*b*, as described in greater detail below.

Second carrier strip 84 is used in a conventional manner to index the strip of terminals through appropriate processing machines. To that end, carrier strip 84 includes a plurality of indexing holes 86 as is known in the art. It should be noted that carrier strip 84 interconnects only alternating ones of the tail portions of the terminals, namely, tail portions 64 of each of first terminals 58*a*.

Figure 13:
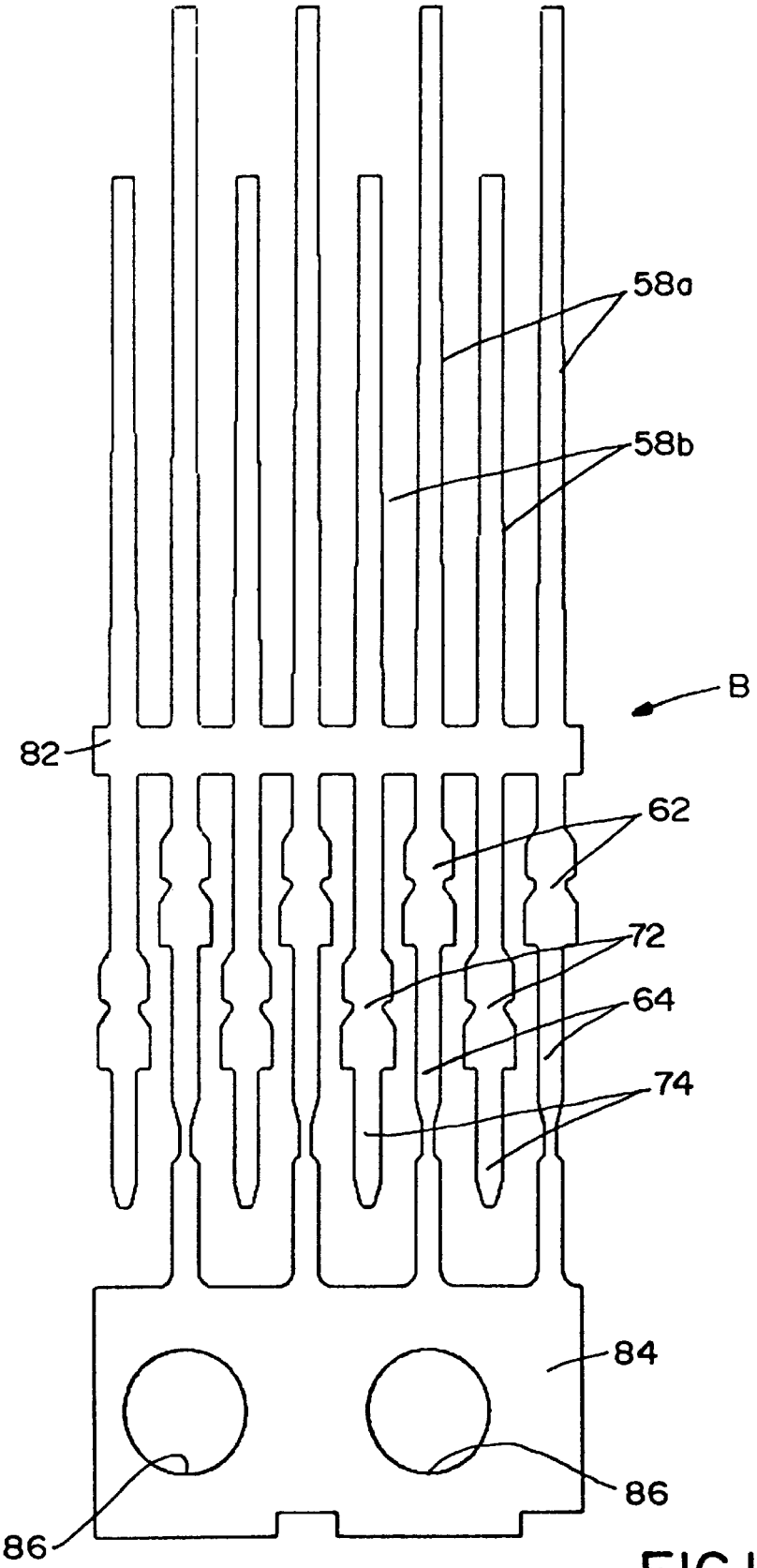
FIG. 13 is a plan view of the elongate strip of terminals after just the stamping step and prior to being formed into the configuration of FIG. 12.

FIG. 13 shows the stamping step in the method of fabricating elongate strip 81 (FIG. 12) of electrical terminals 58*a* and 58*b* prior to forming such terminals. In particular, FIG. 13 shows a flat blank "B" which has been stamped of sheet metal material. The flat outline of terminals 58*a* and 58*b* can be seen in FIG. 13, before the terminals are formed, and with the terminals alternating along the elongate strip and joined by mid-carrier strip 82 and second carrier strip 84. This view clearly shows how the second carrier strip is joined to the tips 64*a* of tail portions 64 of only the first shape of terminals 58*a*. This allows the portions of terminals 58*b* below the mid-carrier strip 82 to move freely during the forming operation relative to the second carrier strip 84.

Figure 15:
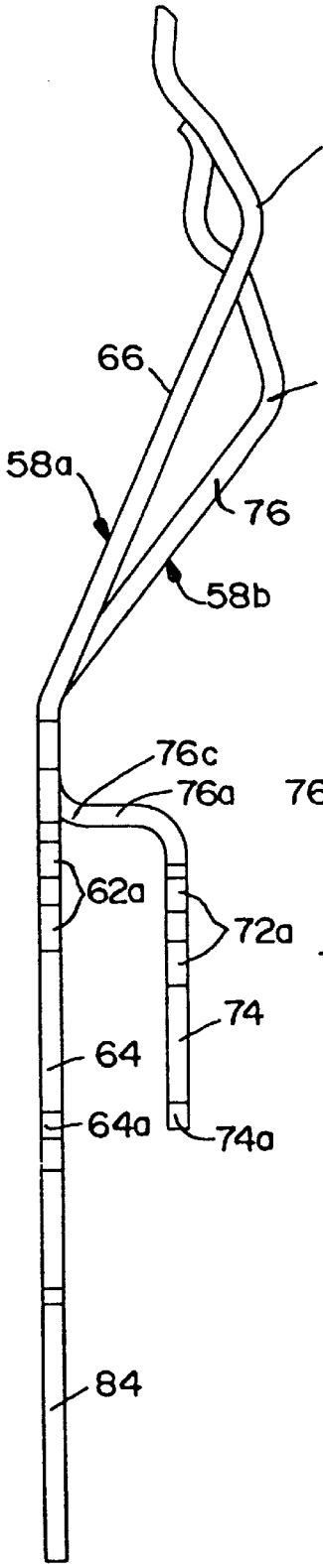
FIG. 15 is a side elevational view of the elongate strip of terminals in FIG. 14.
Figure 14:
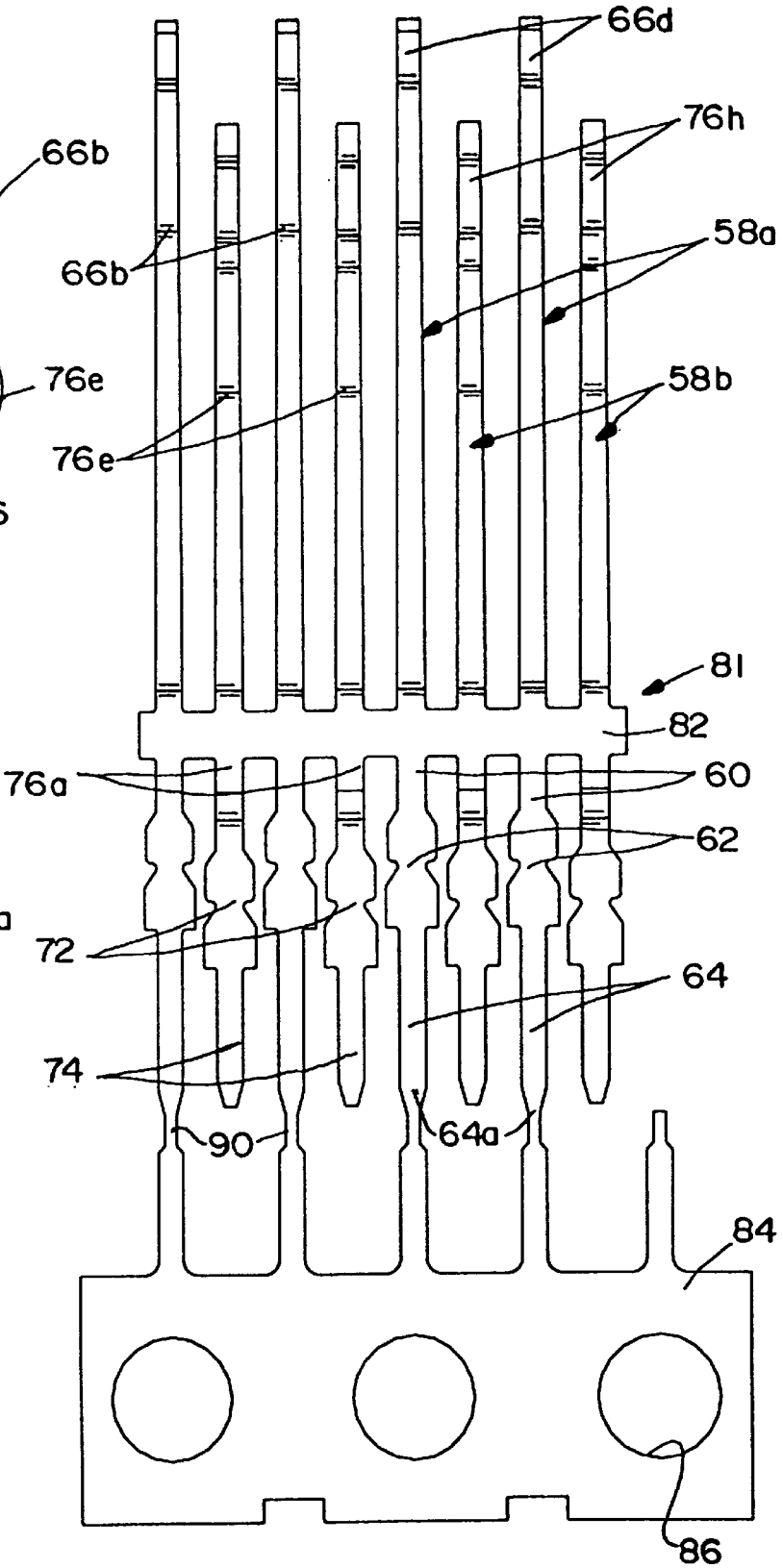
FIG. 14 is a plan view of the stamped and formed strip of terminals as shown in FIG. 12.

FIG. 14 shows the elongate strip 81 of FIG. 13 after it has been fully formed. In essence, FIGS. 14 and 15 correspond to the perspective view of FIG. 12. In particular, blank "B" (FIG. 13) is shaped by appropriate forming processes to define the configurations of spring contact portion 66 of terminals 58*a* and spring contact portion 76 of terminals 58*b* as well as base 70 and tail 74 of terminals 58*b*. FIG. 15 clearly shows how the forming of terminals 58*b* is effective to bring the tips 74*a* of tail portions 74 into substantially the same plane as the tips 64*a* of tail portions 64 of terminals 58*a*. In essence, the vertical distance that tail portions 74 of terminals 58*b* extend from mid-carrier strip 82 has been shortened because the portions of terminals 58*b* below the mid-carrier strip are formed relative to second carrier strip 84. FIGS. 12 and 15 clearly show how this forming step is effective to move retention sections 72 and tail portions 74 of terminals 58*b* out of the plane of retention sections 62 and tail portions 64 of terminals 58*a*. Prior to inserting the terminals into their respective cavities 38*a* and 38*b*, mid-carrier strip 82 is severed. This severing step creates cutoffs 68 and 78. Rather than having to perform a relatively expensive "deburring" process to remove cutoffs 68 and 78, the recesses 46 and 52 of the housing 22 are dimensioned so that recesses 46 and 52 freely accept the protruding cutoffs whereby the cutoffs do not interfere with either insertion of the terminals into their respective cavities or movement of spring contact portion 76 of terminals 58*b* once they are fully inserted. Eventually, either prior to or after insertion of the terminals into their respective cavities, main carrier strip 84 is severed, as at 90 in FIG. 14, to remove the carrier strip from terminals 58*a*.

As stated above, retention bosses 57 are molded integrally with housing 22 in alignment with terminal-receiving passages 38*b*, and the retention bosses actually are "split" portions of housing 22 on opposite sides of terminal-receiving cavities 38*b* adjacent lower portions of retention sections 72 of terminals 58*b*. In other words, in order to minimize the vertical amount of housing above board-mounting face 22*a* utilized to retain terminals 58*b* (which maximizes the vertical height usable for the contact beam 76 of the terminal 58*b*), retention bosses 57 extend downward below board-mounting face 22*a* in order to provide additional material to retain the terminals within the housing. At least portions of the retention sections of terminals 58*b* may be located in the passages through "split" retention bosses 57. In essence, this enables the retention sections of terminals 58*b* to project downwardly below bottom board-mounting face 22*a* of the housing and still be surrounded by sufficient plastic material of the housing to effect a retention function for the terminals between the retention sections and the housing. As a result, a longer portion of terminals 58*b* may be used for the spring contact portions 76. This concept is more fully disclosed in U.S. Pat. No. 5,378,175, issued Jan. 3, 1995 and assigned to the assignee of the present invention. Of course, it should be understood that, in spite of the different shapes of terminals 58*a* and 58*b*, the electrical path lengths from the contact portions to the tails of the terminals are substantially the same.

Figure 16A:
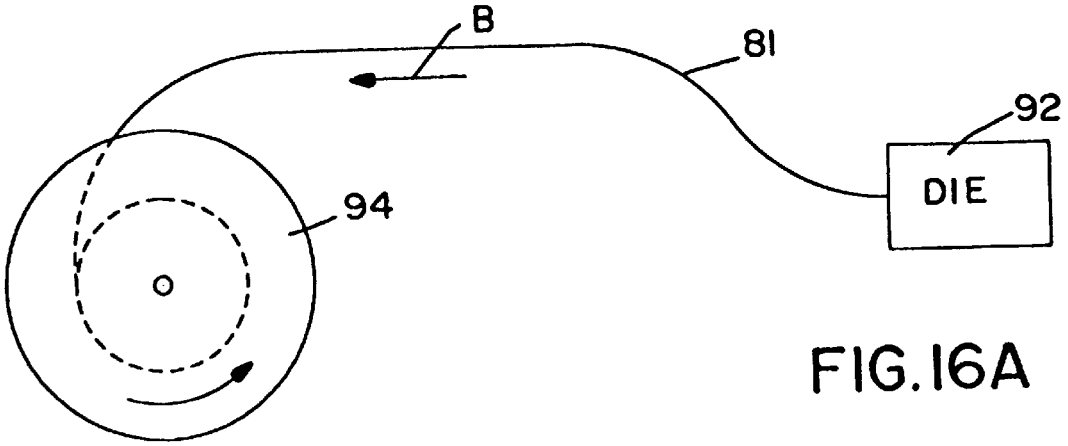
FIGS. 16A–16C are schematic illustrations of processes during the fabrication and subsequent use of the elongate strip of terminals.
Figure 16B:
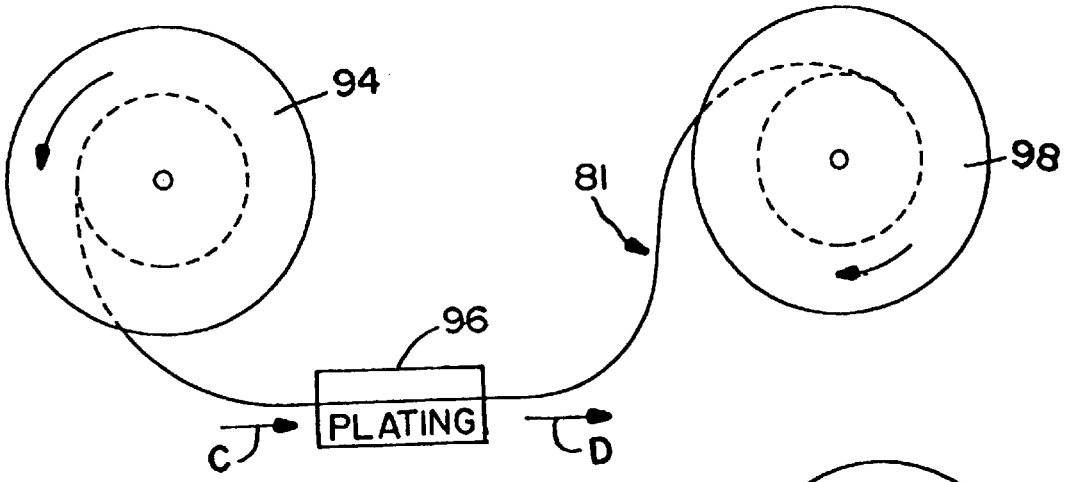
Figure 16C:
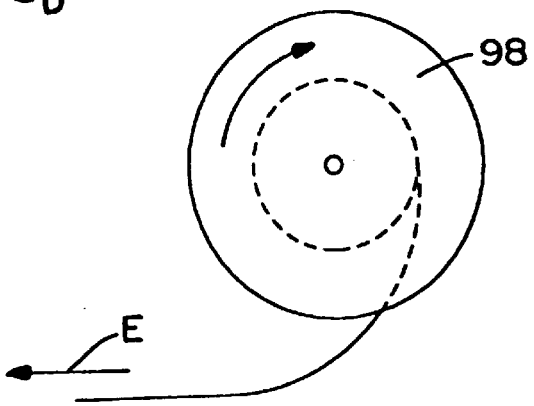

Lastly, FIGS. 16A–16B show how elongate strip 81 of terminals 58*a* and 58*b* (shown in FIGS. 12, 14 and 15) comprise an article of manufacture for subsequent operations and/or use. In particular, FIG. 16A shows strip 81 leaving a die 92 after the final step of stamping and forming the strip into the configuration of FIG. 12. The strip is wound onto a reel 94 in the direction of arrow "B" for subsequent processing steps. FIG. 16B shows strip 81 being wound off of reel 94 in the direction of arrow "C" to a plating station 96 whereat certain portions, such as the contact sections of the terminals, are plated with highly conductive material, such as gold. The plated strip then is fed in the direction of arrow "D" onto a second reel 98. This plating operation normally takes place at a different location than the stamping and forming operations as represented by die 92 in FIG. 16A. In fact, the plating operation may take place in different buildings from the stamping and forming operations. Reel 98, with plated strip 81 wound thereon, then may be shipped to a further location as indicated by FIG. 16C where the strip is unwound from reel 98 in the direction of arrow "E" for further use. For instance, the strip may be unwound at its final destination for inserting terminals 58*a* and 58*b* into connector housing 22 of connector 20, as described above.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An elongate strip of conductive electrical terminals adapted to be inserted into a row of terminal-receiving passages in a connector housing, comprising:

a series of terminals joined by a generally planar carrier strip and including alternating first and second shapes of terminals;

the first shape of terminal including a generally planar base portion in the plane of said carrier strip, said base portion having a retention section for mounting the terminal in a respective one of the terminal-receiving passages, a tail portion projecting from one end of the base portion, and a resilient spring arm having a contact portion extending from an opposite end of the base portion and having at least a portion thereof projecting out of the plane of said carrier strip;

the second shape of terminal including a generally planar base portion in a plane generally parallel to the plane of said carrier strip, said base portion having a retention section for mounting the terminal in a respective one of the terminal-receiving passages, a tail portion projecting from one end of the base portion, and a resilient spring arm having a contact portion extending from an opposite end of the base portion, the spring arm of the second shape of terminal having at least a portion thereof projecting out of the plane of said carrier strip and including a section offset laterally of the base portion thereof; and the carrier strip joining the alternating first and second shapes of terminals at the base portions of the terminals of the first shape and at the offset sections of the spring arms of the terminals of the second shape.

2. The elongate strip of electrical terminals as set forth in claim 1 wherein tips of said tail portions of the first and second shapes of terminals are generally coplanar, and the contact portions of the terminals of the first shape extend a greater distance from the plane of said tips than the contact portions of the terminals of the second shape.

3. The elongate strip of electrical terminals as set forth in claim 2 wherein electrical paths of the first and second shapes of terminals from the plane of said tips to their respective contact portions are substantially equal.

4. The elongate strip of electrical terminals as set forth in claim 1 wherein tips of said tail portions of the first and second shapes of terminals are generally coplanar, and electrical paths of the first and second shapes of terminals from the plane of said tips to the contact portions of the terminals are of substantially equal lengths.

5. The elongate strip of electrical terminals as set forth in claim 1, including a second carrier strip joining tips of the tail portions of at least some of said terminals.

6. The elongate strip of electrical terminals as set forth in claim 5 wherein said second carrier strip joins the tips of the tail portions of only the terminals of said first shape.

7. An elongate strip of electrical terminals adapted to be inserted into a row of terminal-receiving passages in a connector housing, comprising:

a series of alternating first and second shapes of terminals extending generally along a longitudinal axis of said strip, each terminal having an end;

a first generally planar carrier strip attached to the ends of only said first shape of terminals, whereby the ends of said second shape of terminals are unattached to said first carrier strip and deformable independent of the terminals of the first shape; and a second continuous generally planar mid-carrier strip extending in opposite directions from each of said first shape of terminals generally parallel to said axis for supporting terminals of said second shape on opposite sides of each of said first shape of terminals, said first carrier strip and said second carrier strip being in generally parallel planes and said first and second shapes of terminals having at least a portion thereof projecting out of said parallel planes.

8. The elongate strip of electrical terminals as set forth in claim 7 wherein each said terminal includes opposite ends defined by a spring contact end and a tail end, tips of the tail ends of the first and second shapes of terminals being generally coplanar.

9. The elongate strip of electrical terminals as set forth in claim 8 wherein a contact portion on the spring contact end of said first shape of terminals extends a greater distance from the plane of said tips than a contact portion on the spring contact end of the second shape of terminals.

10. The elongate strip of electrical terminals as set forth in claim 9 wherein the electrical paths of the first and second shapes of terminals from the plane of said tips to the contact portions on said spring contact ends of the terminals are of substantially equal lengths.

11. An elongate strip of electrical terminals adapted to be inserted into a row of terminal-receiving passages in a connector housing, comprising:

a series of terminals joined by a generally planar carrier strip and including alternating first and second shapes of terminals;

the first shape of terminals including a generally planar base portion in the plane of said carrier strip, said base portion having a retention section for mounting the terminal in a respective one of the terminal-receiving passages, a deflectable spring arm having a contact portion extending from one end of the base portion and having at least a portion thereof projecting out of the plane of said carrier strip, and a tail portion extending from an opposite end of the base portion;

the second shape of terminals including a generally planar base portion in a plane generally parallel to the plane of said carrier strip, said base portion having a retention section for mounting the terminal in a respective one of the terminal-receiving passages, a deflectable spring arm having a contact portion extending from one end of the base portion and having at least a portion thereof projecting out of the plane of said carrier strip, and a tail portion extending from an opposite end of the base portion, the retention section and tail portion of the second shape of terminals being offset laterally of the retention section and tail portion of the first shape of terminals by a portion of the spring arm of the second shape of terminal;

the carrier strip joining the first and second shapes of terminals at points between the retention sections and tips of the spring arms thereof; and tips of the tail portions of the first and second shapes of terminals being generally coplanar.

12. The elongate strip of electrical terminals as set forth in claim 11 wherein the contact portions of the terminals of the first shape extend a greater distance from the plane of said tips of the coplanar tail portions than the contact portions of the terminals of the second shape.

13. The elongate strip of electrical terminals as set forth in claim 12 wherein the electrical paths of the first and second shapes of terminals from the plane of said tips of the coplanar tail portions to the contact portions of the terminals are of substantially equal lengths.

14. The elongate strip of electrical terminals as set forth in claim 11 wherein the electrical paths of the first and second shapes of terminals from the plane of said tips of the coplanar tail portions to the contact portions of the terminals are of substantially equal lengths.

* * * * *